US010024541B2

(12) United States Patent
Wojick et al.

(10) Patent No.: US 10,024,541 B2
(45) Date of Patent: Jul. 17, 2018

(54) DOUBLE OVEN APPLIANCE

(71) Applicant: General Electric Company, Schenectady, NY (US)

(72) Inventors: Walter Wojick, Lookout Mountain, GA (US); William Byron Wiggins, Marietta, GA (US); Edwin Glenn Zehr, Sugar Valley, GA (US); Kenneth Willard Johnson, Ringgold, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 238 days.

(21) Appl. No.: 15/153,820

(22) Filed: May 13, 2016

(65) Prior Publication Data

US 2017/0328573 A1 Nov. 16, 2017

(51) Int. Cl.

| | |
|---|---|
| ***F24C 1/04*** | (2006.01) |
| ***F24C 7/04*** | (2006.01) |
| ***F24C 7/08*** | (2006.01) |
| ***H05B 6/64*** | (2006.01) |

(52) U.S. Cl.

CPC ..... *F24C 1/04* (2013.01); *F24C 7/043* (2013.01); *F24C 7/08* (2013.01); *H05B 6/64* (2013.01)

(58) Field of Classification Search

CPC ..... H05B 1/0263; H05B 3/0071–3/008; H05B 6/129; H05B 6/6429

USPC ..... 219/618, 628, 632, 756, 757, 391–414

See application file for complete search history.

(56) References Cited

U.S. PATENT DOCUMENTS

| | | | | |
|---|---|---|---|---|
| 4,506,128 | A | 3/1985 | Sujaku et al. | |
| 4,884,626 | A * | 12/1989 | Filipowski | F24C 7/087 165/231 |
| 5,948,301 | A * | 9/1999 | Liebermann | A47J 39/006 219/395 |
| 8,255,820 | B2 * | 8/2012 | Rivlin | G06F 3/147 715/771 |
| 9,074,776 | B2 | 7/2015 | Greenwood et al. | |
| 2002/0190063 | A1 * | 12/2002 | Lee | H05B 6/6423 219/757 |
| 2004/0204780 | A1 * | 10/2004 | Boyer | G05B 23/0272 700/83 |
| 2006/0289489 | A1 | 12/2006 | Wang | |
| 2009/0159584 | A1 * | 6/2009 | Bally | F24C 15/022 219/390 |
| 2009/0242541 | A1 * | 10/2009 | Kwag | F24C 15/04 219/391 |
| 2009/0242542 | A1 * | 10/2009 | Kwag | F24C 15/006 219/391 |
| 2010/0140247 | A1 * | 6/2010 | Watkins | F24C 7/00 219/391 |

(Continued)

*Primary Examiner* — Michael Laflame, Jr.

(74) *Attorney, Agent, or Firm* — Dority & Manning, P.A.

(57) ABSTRACT

A double oven appliance having an upper and lower oven positioned below the upper oven along a vertical direction such that a gap is defined between a top wall of the lower oven and a bottom wall of the upper oven. A bracket having a mounting platform positioned within the gap and spaced from the top wall of the lower oven along the vertical direction. The double oven appliance further including a circuit board coupled to the mounting platform such that the circuit board may be spaced from the top wall of the lower oven along the vertical direction. Further, the circuit board may be cooled by a cooling medium flowing across the circuit board.

20 Claims, 12 Drawing Sheets

(56) References Cited

U.S. PATENT DOCUMENTS

| | | | | |
|---|---|---|---|---|
| 2011/0114624 | A1* | 5/2011 | Chung | A47J 39/006 219/385 |
| 2011/0114625 | A1* | 5/2011 | Chung | A47J 39/006 219/385 |
| 2012/0152226 | A1 | 6/2012 | Oagley et al. | |
| 2014/0197150 | A1* | 7/2014 | Varhabhatla | F24C 7/082 219/419 |

* cited by examiner

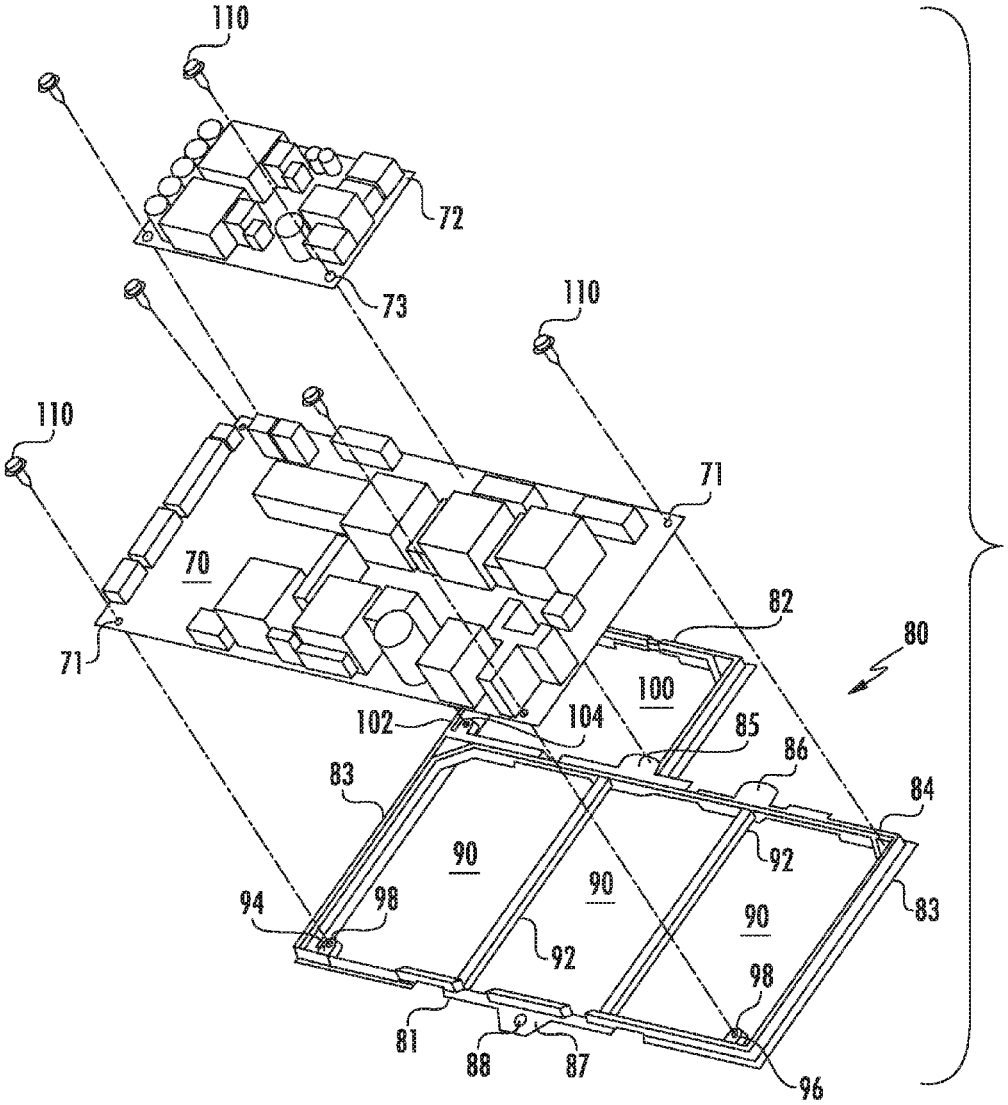
FIG. 6
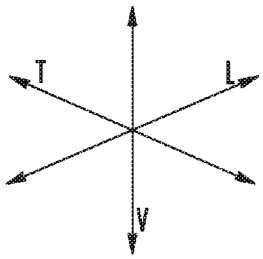

DOUBLE OVEN APPLIANCE

FIELD OF THE INVENTION

The present subject matter relates generally to oven appliances, specifically double oven appliances. More particularly, the present subject matter relates to the position and orientation of circuit boards within double oven appliances.

BACKGROUND

Double oven appliances generally include an upper and lower oven. The upper and lower ovens each include a back wall, a top wall and a bottom wall spaced from the top wall by opposing side walls. In certain double oven appliances, the lower oven is positioned below the upper oven along a vertical direction such that a gap is defined between the top wall of the lower oven and the bottom wall of the upper oven. Further, circuit boards, such as control boards for the upper and lower oven, may be stored within the gap.

When a circuit board is secured within the gap, the circuit board is generally mounted to the top wall of the lower oven. Also, in order to prevent overheating, a cooling medium is blown across a top surface of the circuit board. However, such an arrangement does not always properly cool the circuit board. For example, since a bottom surface of the circuit board touches the top wall of the lower oven, the bottom surface of the circuit board absorbs thermal energy from the lower oven. Further, since the cooling medium only flows across the top surface of the circuit board, the cooling medium cannot sufficiently cool thermal energy absorbed through the bottom surface of the circuit board. As such, the circuit board is susceptible to overheating, which may have a negative effect on the operation of the circuit board or, even worse, cause irreversible damage.

Accordingly, an improved double oven appliance would be desired in the art. In particular, a double oven appliance that decreases or eliminates excess heating of circuit boards disposed within the gap is desired.

BRIEF DESCRIPTION OF THE INVENTION

Aspects and advantages of the invention will be set forth in part in the following description, or may be obvious from the description, or may be learned through practice of the invention.

In a first exemplary embodiment, a double oven appliance is provided. The double oven appliance may define a vertical direction, a longitudinal direction, and a transverse direction that are each perpendicular to each other. The double oven appliance may generally include an upper oven and a lower oven. The upper oven may have a back wall, a top wall and a bottom wall spaced from the top wall by opposing sidewalls. The lower oven may also have a back wall, a top wall and a bottom wall spaced from the top wall by opposing sidewalls. Further, the lower oven may be positioned below the upper oven along the vertical direction such that a gap is defined between the top wall of the lower oven and the bottom wall of the upper oven. In addition, double oven appliance may also include a bracket having a mounting platform positioned within the gap and spaced from the top wall of the lower oven along the vertical direction. The double oven appliance may also include a circuit board coupled to the mounting platform such that the circuit board may be spaced from the top wall of the lower oven along the vertical direction.

In a second exemplary embodiment, a double oven appliance is provided. The double oven appliance may define a vertical direction, a longitudinal direction, and a transverse direction that are each perpendicular to each other. The double oven appliance may generally include an upper oven and a lower oven. The upper oven may have a back wall, a top wall and a bottom wall spaced from the top wall by opposing sidewalls. The lower oven may also have a back wall, a top wall and a bottom wall spaced from the top wall by opposing sidewalls. Further, the lower oven may be positioned below the upper oven along the vertical direction such that a gap is defined between the top wall of the lower oven and the bottom wall of the upper oven. In addition, double oven appliance may also include a bracket having a mounting platform and a plurality of support members extending from the mounting platform along the vertical direction. The mounting platform may be positioned within the gap and spaced from the top wall of the lower oven along the vertical direction. Further, each of the plurality of support members may be coupled to the top wall of the lower oven. Still further, a dielectric material may be positioned between top wall of the lower oven and each of the plurality of support members along the vertical direction. The double oven appliance may also include a frame having a front, a back and opposing side walls. The frame may be mounted to mounting platform of bracket, and a circuit board may be coupled to frame. Further, the circuit board may be spaced from the top wall of the lower oven along the vertical direction and the bottom wall of the upper oven along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which:

FIG. 6 provides a perspective view of a first and second circuit board coupled to the bracket shown in FIG. 5.

FIG. 11 provides a front view of the bracket and circuit board shown in FIG. 8 and depicts a cooling medium flowing across first and second circuit boards along transverse direction.

Figure 1:
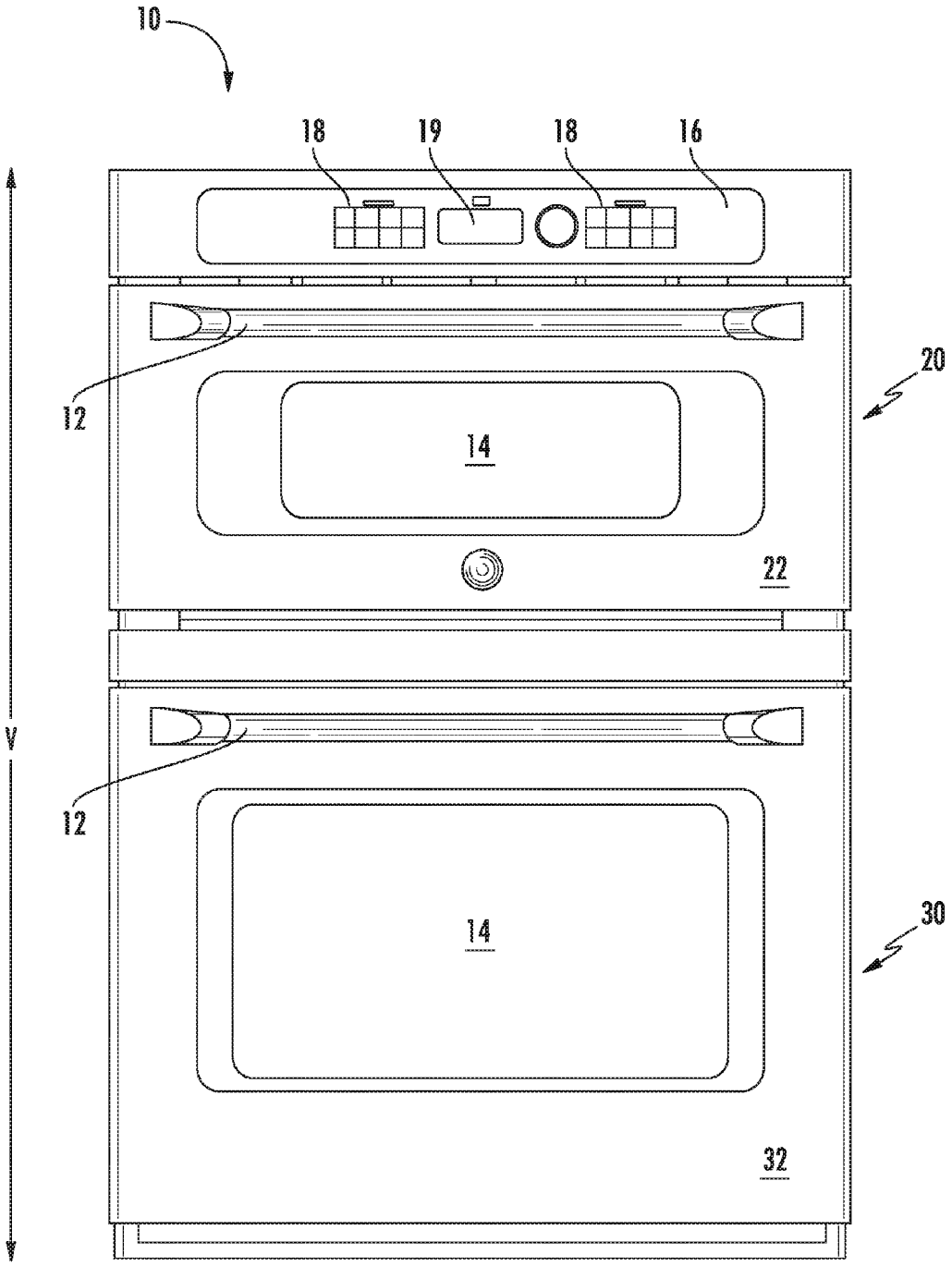
FIG. 1 provides a front view of a double oven appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

Referring now to the drawings, FIG. 1 illustrates an exemplary embodiment of a double appliance 10 according to the present disclosure. Double oven appliance 10 defines a vertical direction V, a longitudinal direction L and a transverse direction T. The vertical, longitudinal and transverse directions are mutually perpendicular and form an orthogonal direction system. Double oven appliance 10 includes an upper oven 20 and a lower oven 30 positioned below upper oven 20 along the vertical direction V. Upper and lower ovens 20 and 30 include cooking chambers 21 and 31, respectively, configured for the receipt of one or more food items to be cooked. Double oven appliance 10 includes an upper door 22 and a lower door 32 in order to permit selective access to cooking chambers 21 and 31, respectively. Handles 12 are mounted to upper and lower doors 22 and 32 to assist a user with opening and closing doors 22 and 32 in order to access cooking chambers 21 and 31. As an example, a user can pull on handle 12 mounted to upper door 22 to open or close upper door 22 and access cooking chamber 21. Glass window panes 14 provide for viewing the contents of cooking chambers 21 and 31 when doors 22, 32 are closed and also assist with insulating cooking chambers 21 and 31. As illustrated further in FIGS. 2 and 3, heating elements, such as electric resistance heating elements, gas burners, microwave elements, etc., are positioned within upper and lower oven 20 and 30.

A control panel 16 of double oven appliance 10 provides selections for user manipulation of the operation of double oven appliance 10. For example, a user can touch control panel 16 to trigger one of user inputs 18. In response to user manipulation of user inputs 18, various components of the double oven appliance 10 can be operated. Control panel 16 may also include a display 19, such as a digital display, operable to display various parameters (e.g., temperature, time, cooking cycle, etc.) of the double oven appliance 10.

Figure 2:
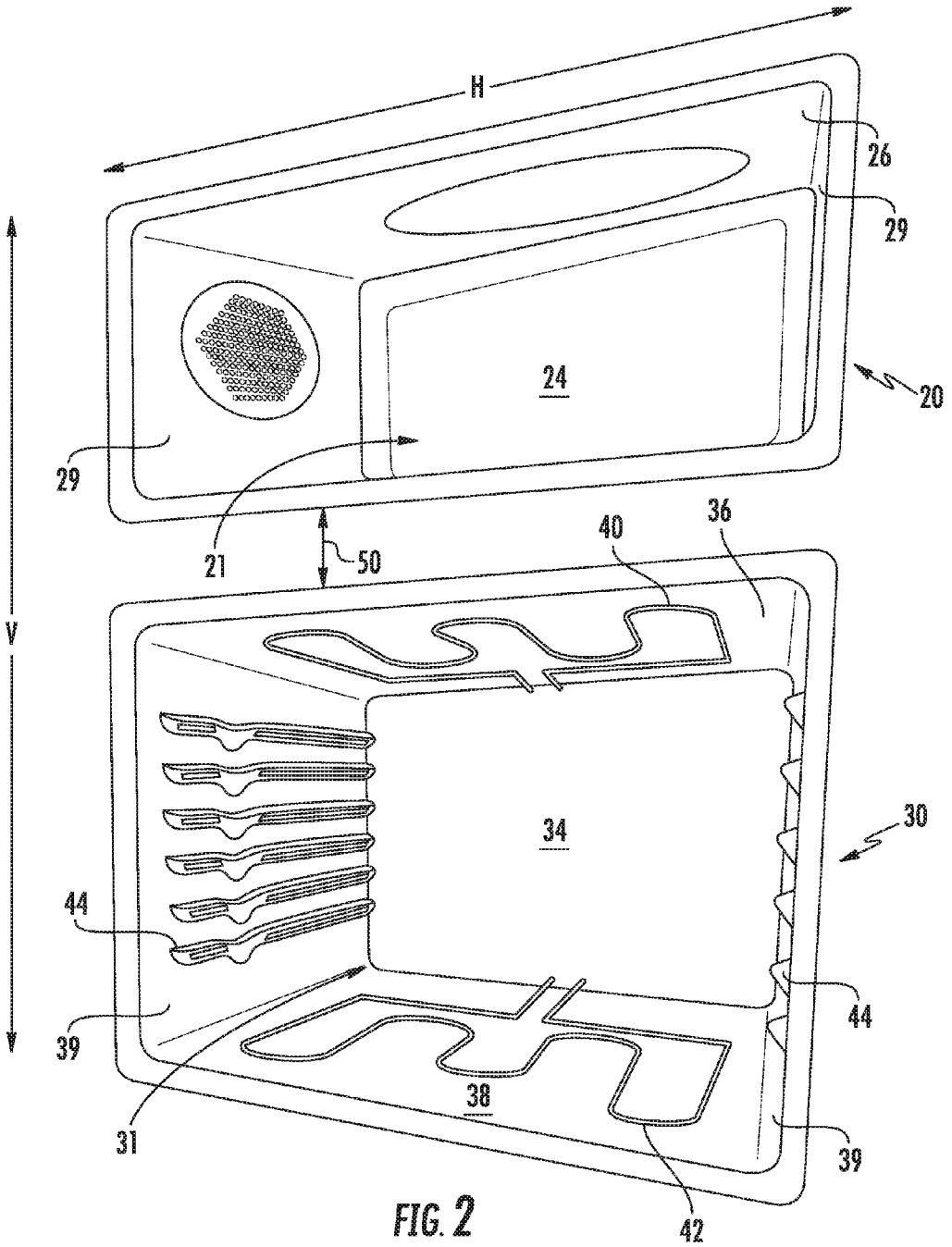
FIG. 2 provides a perspective view of the upper and lower oven shown in FIG. 1.
Figure 3:
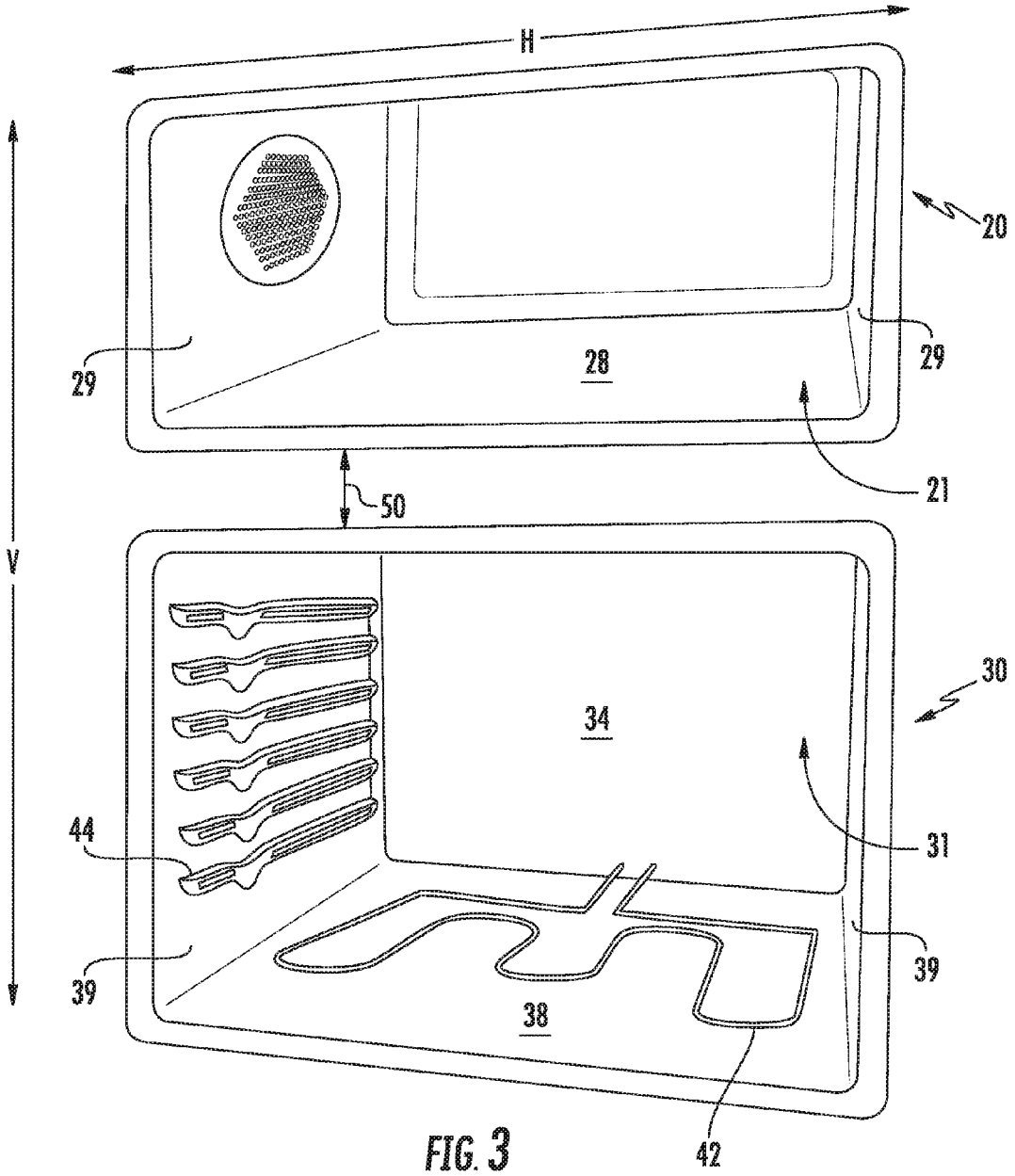
FIG. 3 provides a perspective view of the upper and lower oven shown in FIG. 1.

FIGS. 2 and 3 illustrate perspective views of upper and lower oven 20, 30 without doors 22 and 32, respectively. In the embodiment shown, cooking chamber 21 of upper oven 20 is defined by a back wall 24, a top wall 26 and a bottom wall 28 spaced from top wall 26 along the vertical direction V by opposing side walls 29. In some embodiments, upper oven 20 is a microwave oven requiring a power supply of about 120 volts or is an oven which includes microwave oven features.

Similar to cooking chamber 21 of upper oven 20, cooking chamber 31 of lower oven 30 is defined by a back wall 34, a top wall 36 and a bottom wall 38 spaced from top wall 36 along the vertical direction V by opposing side walls 39. Lower oven 30 also includes heating elements 40 and 42 mounted to top and bottom walls 36 and 38, respectively. Heating elements 40 and 42 may be controlled by user via a selection of one or more user inputs 18 on control panel 16. In the embodiment shown, opposing side walls 39 of lower oven 30 include embossed ribs 44 such that a baking rack (not shown) containing food items may be slidably received onto embossed ribs 44 and may be moved into and out of cooking chamber 31 when door 32 is open. In some embodiments, lower oven 30 is a convection oven requiring a power supply of about 240 volts.

Figure 4:
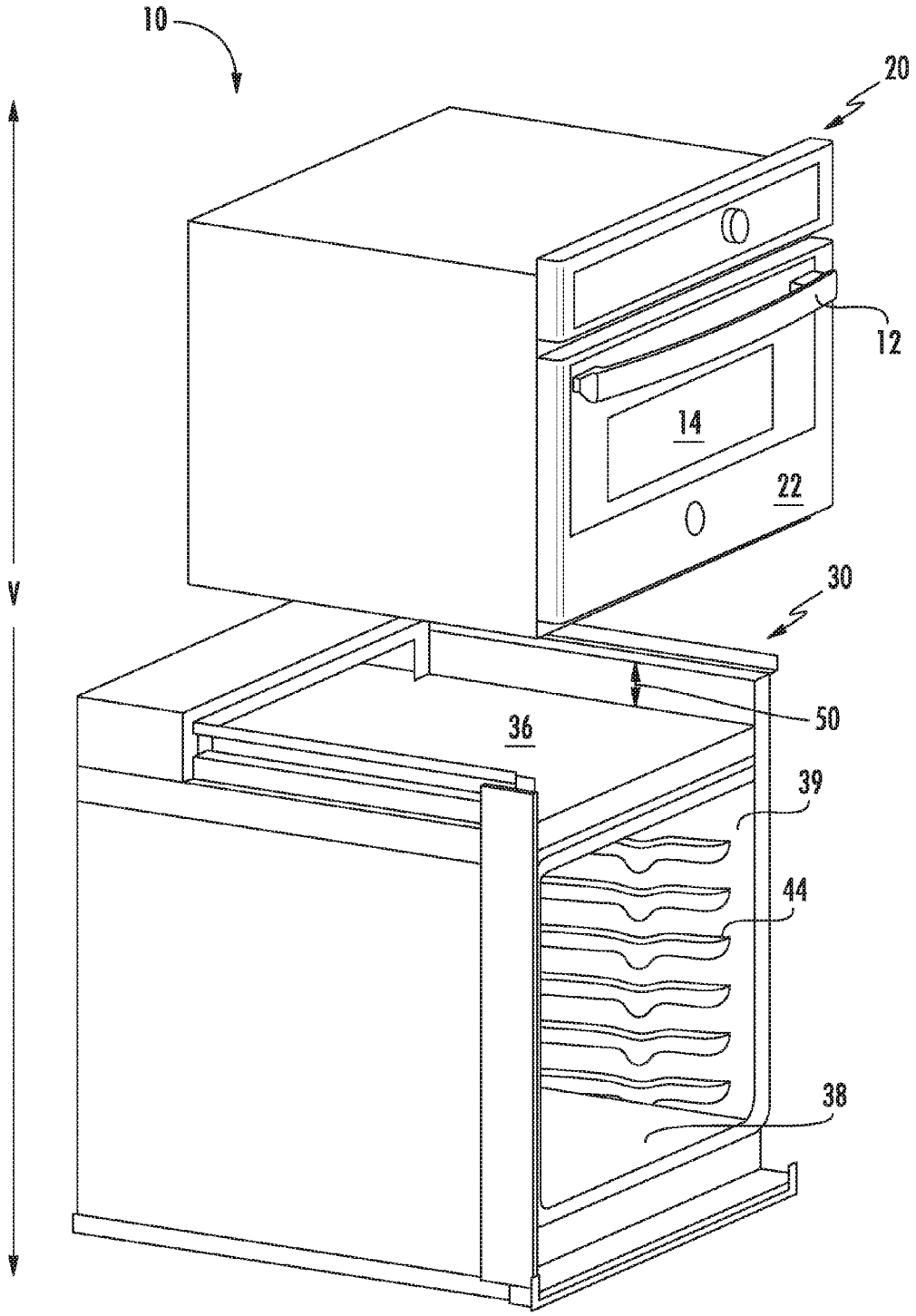
FIG. 4 provides a side perspective view of the double oven appliance shown in FIG. 1.
Figure 5:
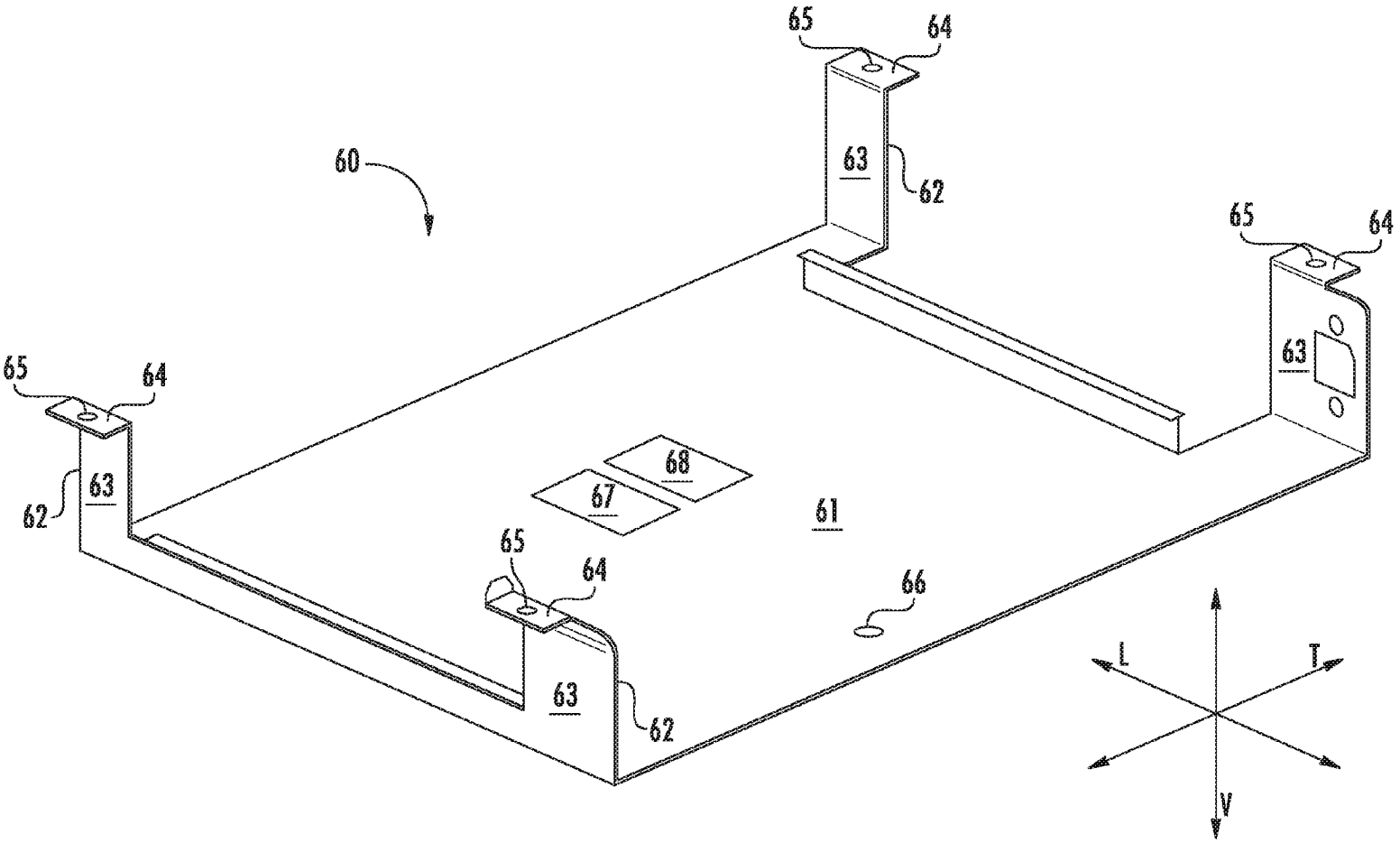
FIG. 5 provides a perspective view of a bracket according to an exemplary embodiment of the present disclosure.

FIGS. 2-4 depict upper oven 20 spaced from lower oven 30 along vertical direction V such that a gap 50 is defined between top wall 36 of lower oven 30 and bottom wall 28 of upper oven 20. It is understood that top wall 36 of lower oven 30 extends from cooking chamber 31 to gap 50 along vertical direction V, and may include one or more layers of insulating material therebetween. Likewise, bottom wall 28 of upper oven 20 extends from cooking chamber 21 to gap 50 along vertical direction V, and may also include one or more layers of insulating material therebetween. As illustrated in FIGS. 5-9 and discussed below in more detail, circuit boards of double oven appliance 10 may be disposed within gap 50 such that circuit boards are spaced from top wall 36 of lower oven 30 along vertical direction V.

FIGS. 5-9 depict a first and second circuit board 70 and 72 of double oven appliance 10 coupled to a bracket 60 disposed within gap 50. Bracket 60 defines a vertical direction V, a longitudinal direction L and a transverse direction T. The vertical, longitudinal and transverse directions are mutually perpendicular and form an orthogonal direction system. Bracket 60 includes a mounting platform 61 and a plurality of support members 62 extending from mounting platform 61 along vertical direction V. Mounting surface 61 may also define an aperture 66, a first slot 67 and a second slot 68. As illustrated in FIGS. 6-10 and discussed herein, aperture 66, first slot 67, and second slot 68 may be used to couple first and second circuit boards 70, 72 to mounting platform 61. More specifically, first and second circuit boards 70, 72 may be coupled to mounting platform 61 such that first and second circuit boards 70, 72 are spaced from top wall 36 of lower oven 30 along vertical direction V.

Each support member 62 of bracket 60 includes a leg portion 63 and a foot portion 64. Leg portion 63 extends from mounting platform 61 along vertical direction V. Foot portion 64 extends orthogonally from leg portion 63 along transverse direction T. Foot portion 64 may also define an aperture 65 which may be aligned with an aperture (not shown) formed on top surface 36 of lower oven 30. Further, bracket 60 may be fastened to top wall 36 of lower oven 30 with a mechanical fastener (not shown) extending through aperture 65 of foot portion 64 and aperture formed on top wall 36 of lower oven 30 along vertical direction V. Alternatively, foot portion 64 may be attached to top wall 36 of lower oven 30 via any suitable bonding material.

Figure 7:
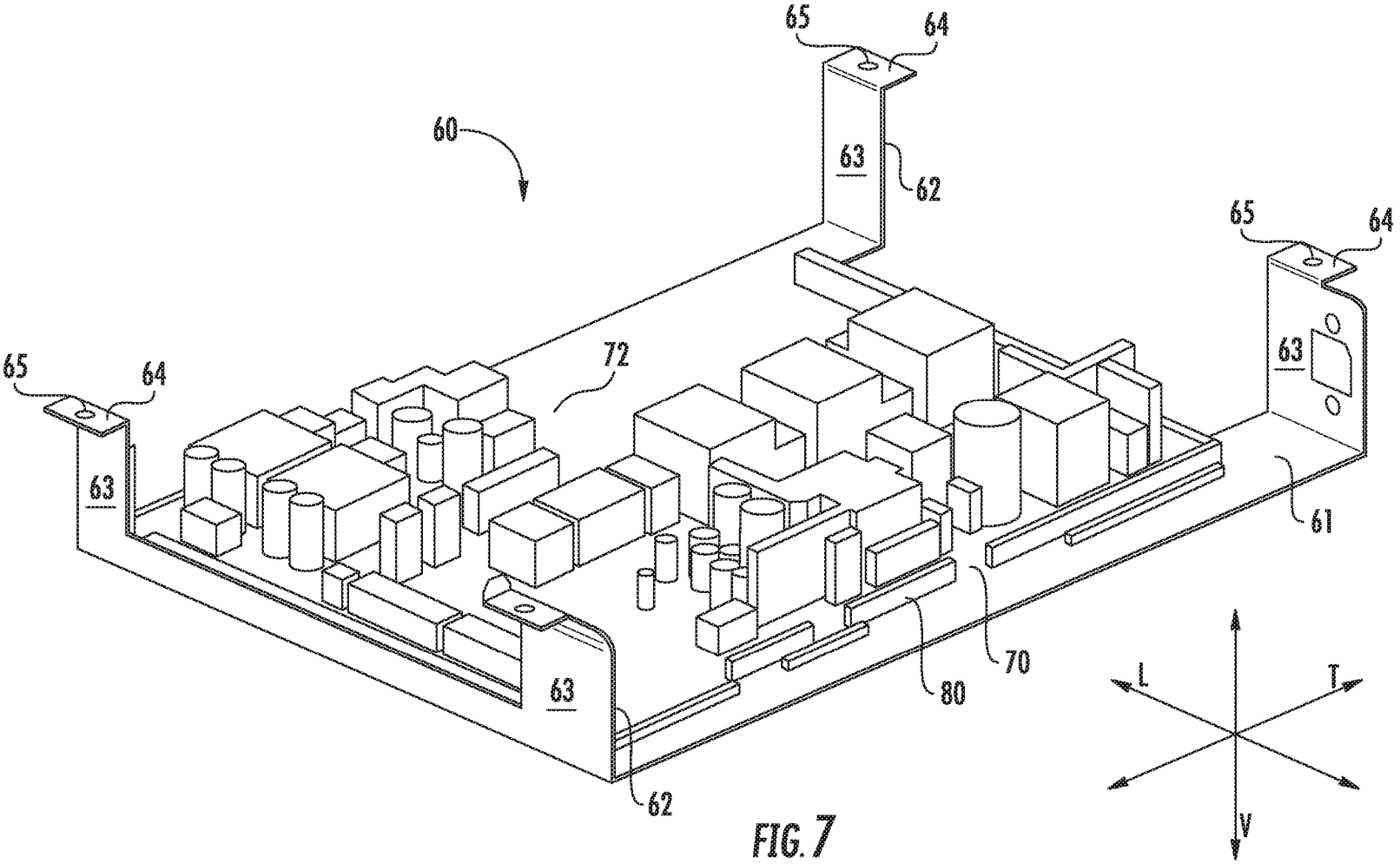
FIG. 7 provides an assembled view of FIG.6.

FIGS. 6 and 7 depict an exemplary embodiment of first and second circuit boards 70, 72 coupled to bracket 60 via a frame 80. As shown, frame 80 includes a front 81, a back 82, and opposing side walls 83. Frame 80 also includes a cross-member 84 extending between opposing side walls 83. Cross-member 84 divides frame 80 into a first portion 90 and a second portion 100. First portion 90 is adapted to receive first circuit board 70. Second portion 100 is adapted to receive second circuit board 72.

In the embodiment shown, first portion 90 of frame 80 includes a plurality of members 92 spaced apart along traverse direction T. Further, each of the members 92 extend from front 81 of frame 80 to cross-member 84 along longitudinal direction L. First portion 90 also includes tabs 94, 96 spaced between opposing side walls 83 of frame 80 and member 92 along traverse direction T. Tabs 94, 96 extend from front 81 of frame 80 towards cross-member 84 along longitudinal direction L. Each tab 94, 96 may also define an aperture 98. First circuit board 70 defines a plurality of apertures 71. In this embodiment, first circuit board 70 may be positioned within first portion 90 of frame 80 such that first circuit board 70 is positioned below tabs 94 and 96 along vertical direction V. Further, apertures 71 of first circuit board 70 may be aligned with apertures 98 of tabs 94 and 96 such that first circuit board 70 may be fastened to first portion 90 of frame 80 via a mechanical fastener 110 extending through apertures 98 and apertures 71 along vertical direction V.

As shown in FIG.6, second portion 100 of frame 80 includes a tab 102 extending from cross-member 84 towards back 82 of frame 80 along longitudinal direction L. Tab 102 may define an aperture 104, and second circuit board 72 may define a plurality of apertures 73. In this embodiment, second circuit board 72 may be positioned within second portion 100 such that second circuit board 72 is positioned below tab 102 along vertical direction V. Further, one of the plurality of apertures 73 formed on second circuit board 72 may be aligned with aperture 104 of tab 102 such that second circuit board 72 may be fastened to second portion 100 of frame 80 via a mechanical fastener 110 extending through one of apertures 73 formed on second circuit board 72 and aperture 104 of tab 102 along vertical direction V.

Figure 9:
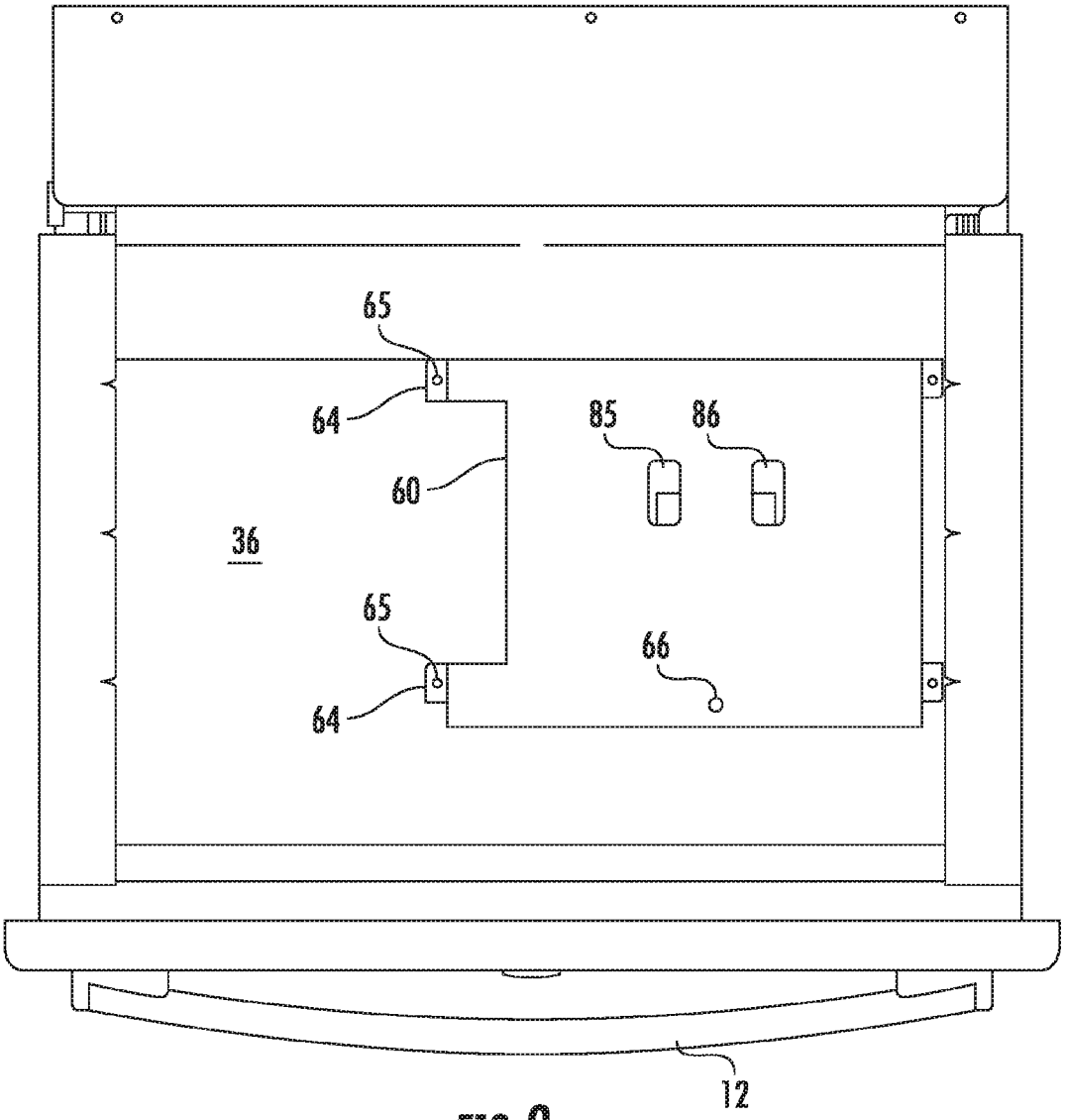
FIG. 9 provides a top view of the lower oven according to FIG. 8.

Frame 80 also includes a first and second tab 85 and 86 extending from cross-member 84 toward back 82 of frame 80 along longitudinal direction L. As illustrated in FIG. 9 and discussed herein, frame 80 may be positioned on mounting platform 61 such that first and second tabs 85 and 86 are received into first and second slots 67, 68 formed on mounting platform 61. Frame 80 may also define a third tab 87 extending from front 81 of frame 80 along longitudinal direction L. In the embodiment shown, third tab 87 also defines an aperture 88 that aligns with aperture 66 of mounting platform 61 along vertical direction V when first and second tab 85 and 86 are received into first and second slots 67 and 68 of mounting platform 61. Further, frame 80 may be fastened to mounting platform 61 via a mechanical fastener (not shown) extending through aperture 88 of third tab 87 and aperture 66 of mounting platform 61 along the vertical direction V.

Figure 8:
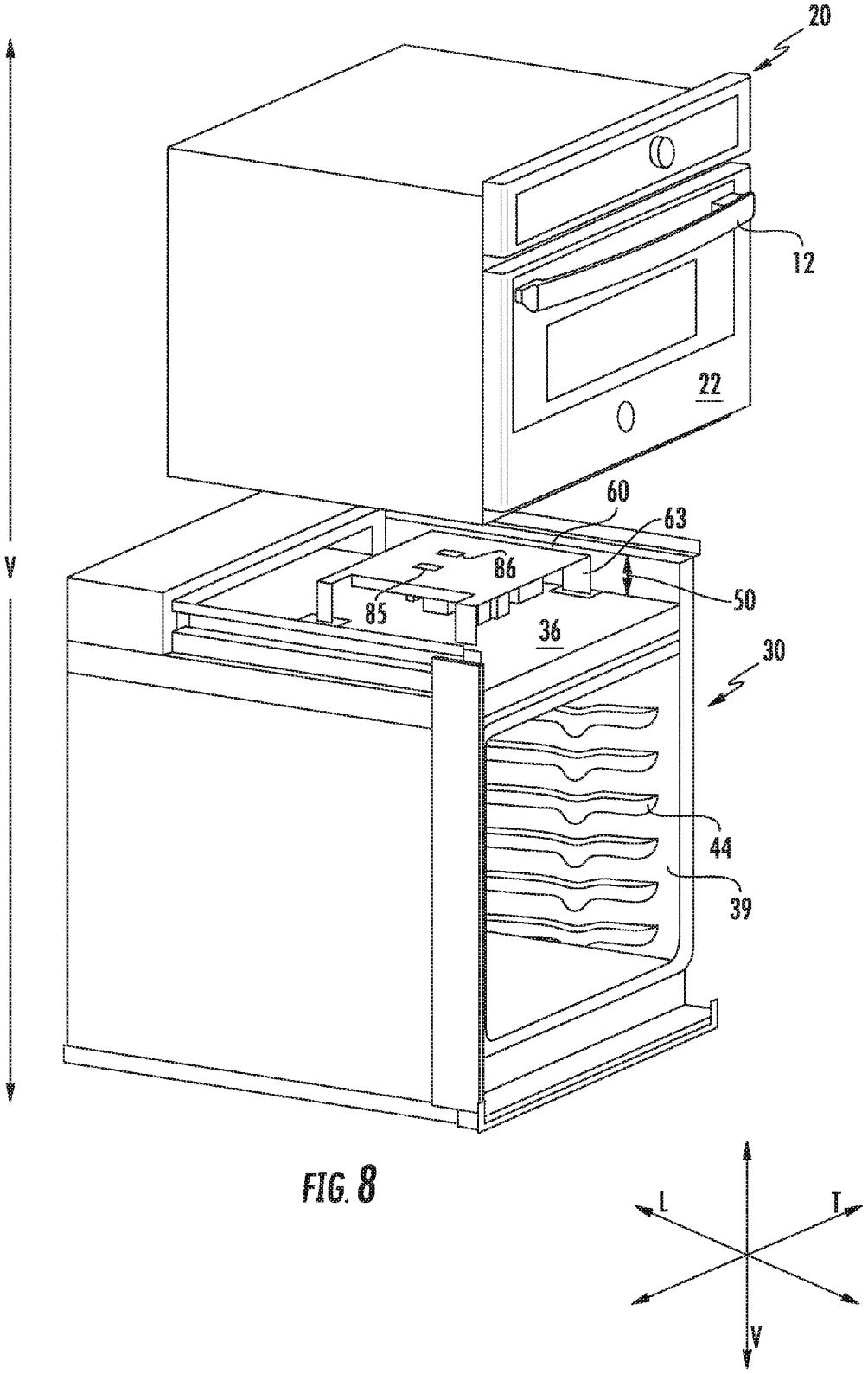
FIG. 8 provides a side perspective of a double oven appliance according to an exemplary embodiment of the present disclosure.
Figure 10:
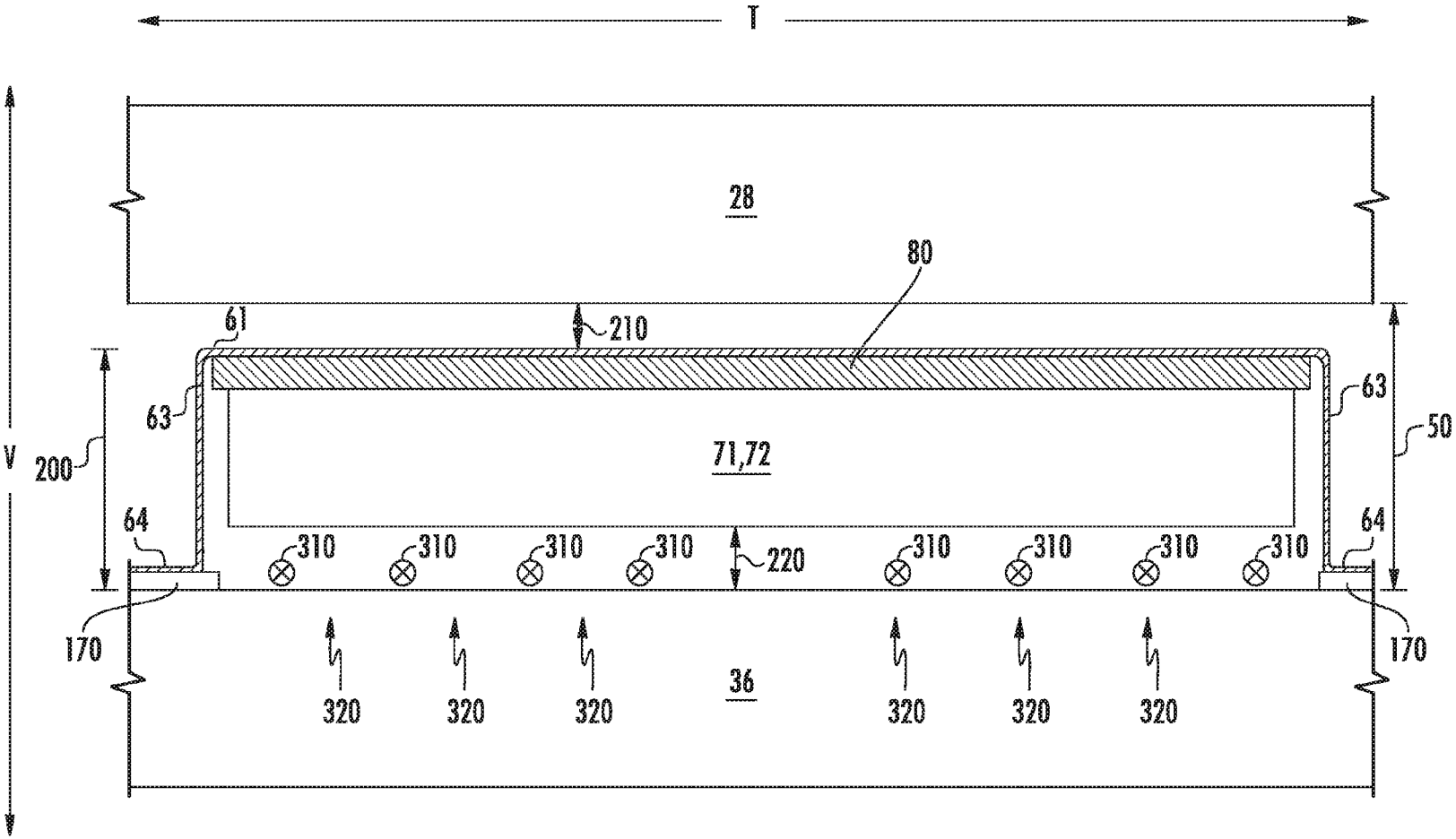
FIG. 10 provides a front view of the bracket and circuit board shown in FIG. 8 and depicts a cooling medium flowing across first and second circuit boards along longitudinal direction.
Figure 17:
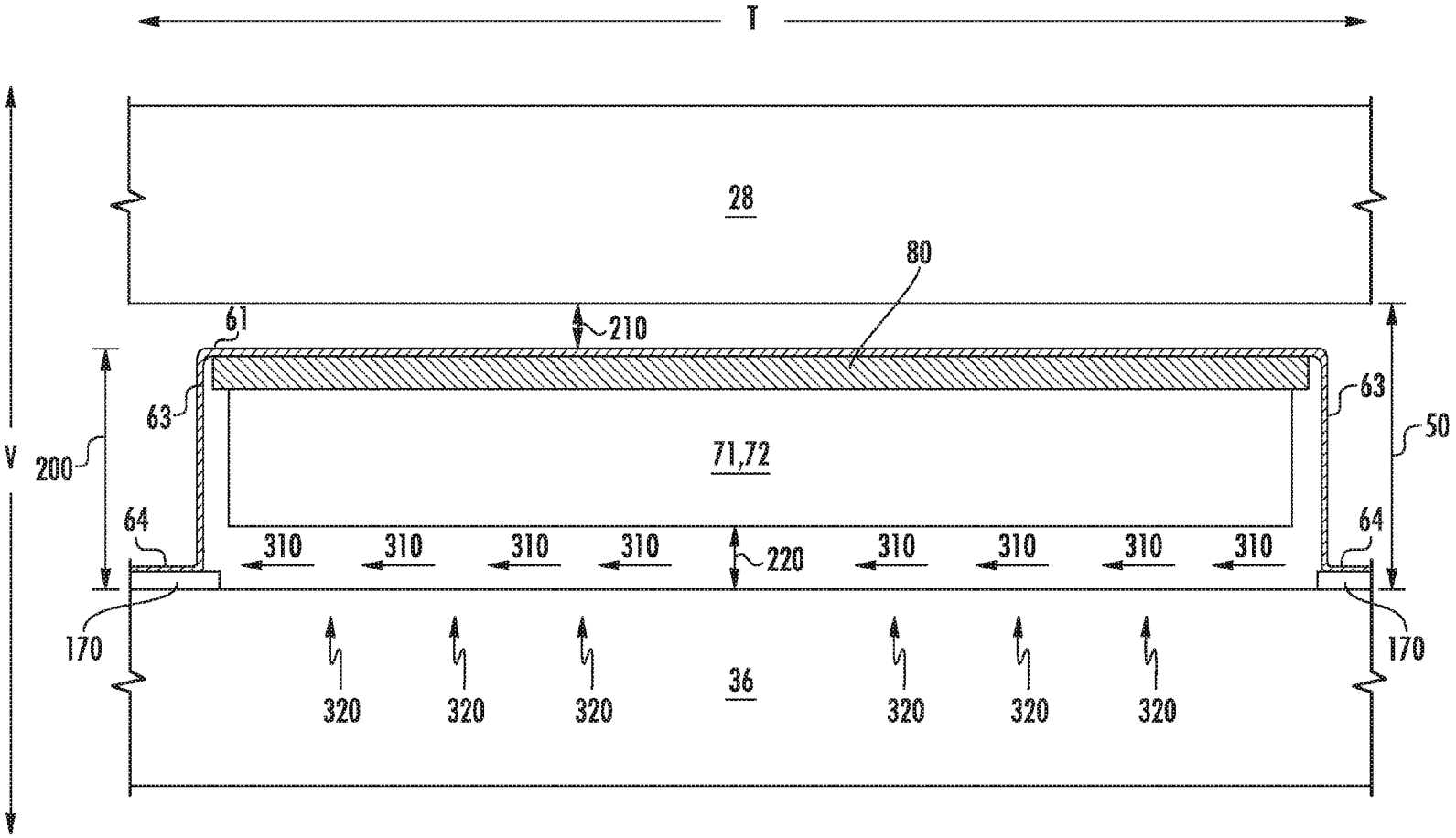

FIGS. 8, 10 and 11 depict first and second circuit board 70, 72 disposed within gap 50 and coupled to mounting platform 61 of bracket 60 via frame 80. Also, as shown in FIGS. 10 and 11, a dielectric material 170 is positioned between foot portion 64 of each support member 62 along vertical direction V. Dielectric material 170 may be made of any suitable material that reduces or eliminates heat transfer between lower oven 30 and bracket 60. As an example, dielectric material may be an inorganic insulating paper, such as fish paper.

Mounting platform 61 may be positioned within gap 50 such that a first distance 200 defined between mounting platform 61 and top wall 36 of lower oven 30 is greater than a second distance 210 defined between mounting platform 61 and bottom wall 28 of upper oven 20 along vertical direction V. Further, a third distance 220 that is less than first distance 200 may be defined between the top wall 36 of the lower oven 30 and the first and second circuit board 70, 72.

In one embodiment, first distance 200 is between approximately 1.0 inches and approximately 1.5 inches. In another embodiment, first distance may is between approximately 1.25 inches and approximately 1.5 inches. Still further, in yet another embodiment, first distance 200 may be equal to approximately 1.5 inches.

In one embodiment, second distance 210 is between approximately 0.1 inches and approximately 0.5 inches. In another embodiment, second distance 210 is between approximately 0.25 inches and approximately 0.5 inches. In yet another embodiment, second distance 210 is equal to approximately 0.5 inches.

In one embodiment, third distance 220 is between approximately 0.1 inches and 0.25 inches. In another embodiment, third distance 220 is between approximately 0.15 inches and approximately 0.25 inches. In yet another embodiment, third distance 220 is equal to approximately 0.25 inches.

As shown in FIGS. 10 and 11, first and second circuit boards 70 and 72 may be cooled by a cooling medium 310 flowing across first and second circuit boards 70 and 72. More specifically, cooling medium 310 may flow across first and second circuit boards 70 and 72 along longitudinal direction L. Further, cooling medium 310 may also flow across first and second circuit boards 70 and 72 along transverse direction T. Cooling medium 310 may be, without limitation, cooled air from a blower (not shown) positioned within gap 50. In the embodiment shown in FIGS. 10 and 11, cooling medium 310 cools thermal energy320 entering gap 50 through top wall 36 of lower oven 30. More specifically, thermal energy 320 flows along vertical direction V and merges with cooling medium 310 prior to reaching temperature sensitive components of first and second circuit boards 70 and 72. As such, spacing first and second circuit board 70 and 72 from top wall 36 of lower oven 30 along vertical direction V reduces or eliminates likelihood of first and second circuit board 70 and 72 overheating due to absorption of thermal energy 320 from lower oven 30.

Figure 12:
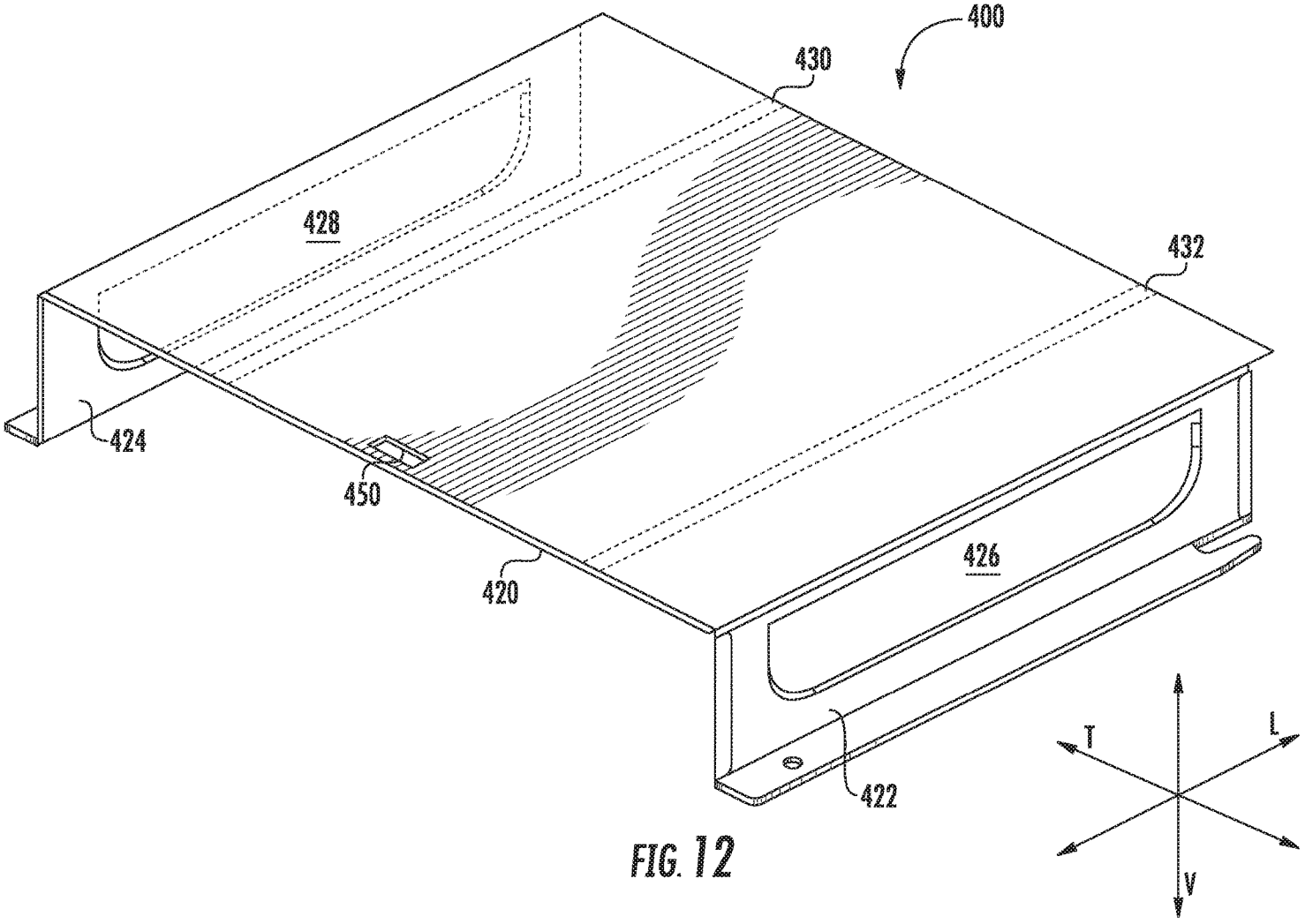
FIG. 12 provides a perspective view of a bracket according to another exemplary embodiment of the present disclosure.

FIG. 12 depicts another exemplary embodiment of a bracket 400 that defines a vertical direction V, a longitudinal direction L and a transverse direction T. The vertical, longitudinal and transverse directions are mutually perpendicular and form an orthogonal direction system. Bracket 400 includes a mounting platform 420 and a first support member 422 spaced from a second support member 424 along transverse direction T. First and second support members 422, 424 also extend from mounting platform 420 along vertical direction V, and may also define a first and second opening 426 and 428, respectively. In some embodiments, bracket 400 may be disposed within gap 50, and cooling medium 310 may flow across mounting platform 420 along longitudinal direction L. Further, first and second opening 426 and 428 may define a flow path for cooling medium 310 to flow across first and second circuit board 70 and 72 (FIG. 11) along transverse direction T.

Bracket 400 may also include opposing channels 430, 432 formed on mounting platform 420 and spaced apart along transverse direction T. Opposing channels 430, 432 extend along longitudinal direction L and are adapted to receive opposing side walls 83 of frame 80 such that frame 80 is movable onto and off of mounting platform 420. Further, bracket 400 shown in FIG. 11 includes a slot 450 formed on mounting surface 420. In one embodiment, frame 80 is movable along longitudinal direction L of mounting platform 420 until third tab 87 of frame is received into slot 450.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A double oven appliance that defines a vertical direction, a longitudinal direction, and a transverse direction that are each perpendicular to each other, the double oven appliance comprising:

an upper oven having a back wall, a top wall and a bottom wall spaced from the top wall by opposing side walls;

a lower oven having a back wall, a top wall and a bottom wall spaced from the top wall by opposing side walls, the lower oven positioned below the upper oven along the vertical direction such that a gap is defined between the top wall of the lower oven and the bottom wall of the upper oven;

a bracket having a mounting platform, the mounting platform positioned within the gap and spaced from the top wall of the lower oven along the vertical direction; and a circuit board coupled to the mounting platform such that the circuit board is spaced from the top wall of the lower oven along the vertical direction.

2. The double oven appliance of claim 1, wherein the mounting platform is positioned within the gap such that a first distance defined between the mounting platform and the top wall of the lower oven along the vertical direction is greater than a second distance defined between the mounting platform and the bottom wall of the upper oven along the vertical direction.

3. The double oven appliance of claim 1, wherein the bracket includes a first support member and a second support member spaced from the first support member along the transverse direction, and wherein the first and second support member extend from the mounting platform along the vertical direction.

4. The double oven appliance of claim 3, wherein the first and second support member are coupled to the top wall of the lower oven.

5. The double oven appliance of claim 4, further comprising a dielectric material positioned between the top wall of the lower oven and each of the first and second support members along the vertical direction.

6. The double oven appliance of claim 4, wherein a cooling medium flows across the circuit board along the longitudinal direction.

7. The double oven appliance of claim 6, wherein the first support member defines a first opening and the second support member defines a second opening, the first and second opening defining a flow path for the cooling medium to flow across the circuit board along the transverse direction.

8. The double oven appliance of claim 1, further comprising a frame having a front, a back and opposing sides, the frame positioned between the circuit board and the mounting platform along the vertical direction.

9. The double oven appliance of claim 8, wherein the frame includes a tab adapted to be received within a slot formed on the mounting platform.

10. The double oven appliance of claim 9, wherein the mounting platform defines opposing channels spaced apart along the transverse direction of the mounting platform, each of the opposing channels extending along the longitudinal direction.

11. The double oven appliance of claim 10, wherein the opposing channels of the mounting platform are adapted to receive the opposing sides of the frame such that the frame is movable relative to the mounting platform.

12. The double oven appliance of claim 11, wherein the frame is movable along the longitudinal direction of the bracket until the tab is received within the slot of the mounting platform.

13. A double oven appliance that defines a vertical direction, a longitudinal direction, and a transverse direction that are each perpendicular to each other, the double oven appliance comprising:

an upper oven having a back wall, a top wall and a bottom wall spaced from the top wall by opposing side walls;

a lower oven having a back wall, a top wall and a bottom wall spaced from the top wall by opposing side walls, the lower oven positioned below the upper oven along the vertical direction such that a gap is defined between the top wall of the lower oven and the bottom wall of the upper oven;

a bracket having a mounting platform and a plurality of support members extending from the mounting platform along the vertical direction, the mounting platform positioned within the gap and spaced from the top wall of the lower oven along the vertical direction, each of the plurality of support members coupled to the top wall of the lower oven;

a dielectric material positioned between the top wall of the lower oven and each of the plurality of support members along the vertical direction;

a frame having a front, a back and opposing side walls, the frame coupled to the mounting platform; and a circuit board coupled to the frame such the circuit board is spaced from the top wall of the lower oven along the vertical direction and from the bottom wall of the upper oven along the vertical direction.

14. The double oven appliance of claim 13, wherein the mounting platform is positioned within the gap such that a first distance defined between the mounting platform and the top wall of the lower oven along the vertical direction is greater than a second distance defined between the mounting platform and the bottom wall of the upper oven along the vertical direction.

15. The double oven appliance of claim 13, wherein each of the plurality of support members includes a leg portion and a foot portion, the leg portion extending from the mounting surface along the vertical direction, the foot portion extending orthogonally from the leg portion.

16. The double oven appliance of claim 13, wherein the plurality of support member includes a first support member and a second support member extending from the mounting platform along the vertical direction, and wherein the first support member is spaced from the second support member along the transverse direction.

17. The double oven appliance of claim 16, wherein a cooling medium flows across the circuit board along the longitudinal direction.

18. The double oven appliance of claim 17, wherein the first support member defines a first opening and the second support member defines a second opening, and wherein the first and second opening define a flow path for the cooling medium to flow across the first and second circuit board along the transverse direction.

19. The double oven appliance of claim 13, wherein the frame includes a tab adapted to be received within a slot formed on the mounting platform.

20. The double oven appliance of claim 19, wherein the mounting platform defines opposing channels spaced apart along the transverse direction, each of the opposing channels extending along the longitudinal direction.

* * * * *